US009829176B2

(12) United States Patent
Inaba

(10) Patent No.: US 9,829,176 B2
(45) Date of Patent: Nov. 28, 2017

(54) LAMP

(71) Applicant: KOITO MANUFACTURING CO., LTD., Tokyo (JP)

(72) Inventor: Tetsuaki Inaba, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 19 days.

(21) Appl. No.: 14/045,086

(22) Filed: Oct. 3, 2013

(65) Prior Publication Data

US 2014/0098539 A1 Apr. 10, 2014

(30) Foreign Application Priority Data

Oct. 10, 2012 (JP) ..... 2012-225555

(51) Int. Cl.
*F21V 5/04* (2006.01)
*F21V 17/06* (2006.01)
(Continued)

(52) U.S. Cl.
CPC ..... *F21V 5/04* (2013.01); *F21S 48/1154* (2013.01); *F21S 48/1216* (2013.01); *F21V 14/06* (2013.01); *F21V 17/06* (2013.01)

(58) Field of Classification Search
CPC ..... F21K 9/137; F21V 5/041; F21V 5/046; F21V 5/048; F21V 5/007
(Continued)

(56) References Cited

U.S. PATENT DOCUMENTS 2,424,575 A * 7/1947 Aves ..... F21S 8/00 340/815.49
5,469,345 A 11/1995 Pettersen et al.
(Continued)

FOREIGN PATENT DOCUMENTS

JP 2006-286615 A 10/2006
JP 2007335301 12/2007
(Continued)

OTHER PUBLICATIONS

Korean Office Action—Korean Application No. 10-2013-0119661 dated May 30, 2014, citing KR 10-1186838 and US 2012/0044698.
(Continued)

*Primary Examiner* — Andrew Coughlin
*Assistant Examiner* — Christopher E Dunay
(74) *Attorney, Agent, or Firm* — Abelman, Frayne & Schwab

(57) ABSTRACT

A lamp includes a projection lens, a light source disposed behind the projection lens, a lens holder that holds the projection lens, and a lamp body that holds the lens holder while accommodating the light source. In particular, a front surface of the projection lens includes a central region configured by a convex curved surface and a peripheral region around the central region which is configured by an annular concave curved surface, the lens holder is formed in a cylindrical shape and an annular flange portion extending towards an inner peripheral side is formed at a front end of the lens holder, an annular step portion is formed at an outer peripheral edge of the peripheral region on the front surface of the projection lens, and the projection lens is fixed to the annular flange portion of the lens holder at a step surface of the annular step portion.

9 Claims, 7 Drawing Sheets

(51) Int. Cl.
*F21V 14/06* (2006.01)
*F21S 8/10* (2006.01)

(58) Field of Classification Search
USPC .... 362/235, 311.01, 311.02, 311.06, 311.07, 362/324, 335
See application file for complete search history.

(56) References Cited

U.S. PATENT DOCUMENTS

| | | | | |
|---|---|---|---|---|
| 6,819,506 | B1 * | 11/2004 | Taylor | F21L 4/005 359/708 |
| 2004/0190286 | A1 | 9/2004 | Chapman | |
| 2007/0291499 | A1 * | 12/2007 | Tanaka | 362/509 |
| 2008/0037138 | A1 * | 2/2008 | Lang | G02B 13/0045 359/708 |
| 2008/0232110 | A1 * | 9/2008 | Wang | 362/308 |
| 2010/0110695 | A1 * | 5/2010 | Nakamura | 362/311.09 |
| 2011/0128745 | A1 * | 6/2011 | Chen et al. | 362/311.02 |
| 2011/0157905 | A1 * | 6/2011 | Chang | 362/475 |
| 2011/0299287 | A1 * | 12/2011 | Liao | 362/294 |
| 2012/0044698 | A1 | 2/2012 | Hsueh et al. | |
| 2012/0140433 | A1 * | 6/2012 | Armer et al. | 362/6 |
| 2012/0147606 | A1 * | 6/2012 | Huang et al. | 362/277 |
| 2013/0258503 | A1 * | 10/2013 | Lu | G02B 7/026 359/819 |
| 2013/0291414 | A1 * | 11/2013 | Cegnar | 40/559 |

FOREIGN PATENT DOCUMENTS

| | | |
|---|---|---|
| JP | 2009-146665 A | 7/2009 |
| KR | 101186838 | 9/2012 |
| KR | 10-1186838 B | 10/2012 |

OTHER PUBLICATIONS

An Office Action dated Apr. 3, 2015, issued from the Chinese Patent Office (SIPO) of Chinese Patent Application No. 201310435217.0 and an English translation thereof.
An Office Action dated May 31, 2016, issued from the Japanese Patent Office (JPO) of Japanese Patent Application No. 2012-225555 and a Machine translation thereof.

* cited by examiner

LAMP

CROSS-REFERENCE TO RELATED APPLICATIONS

This application is based on and claims priority from Japanese Patent Application No. 2012-225555 filed on Oct. 10, 2012 with the Japan Patent Office and the disclosure of which is incorporated herein in its entirety by reference.

TECHNICAL FIELD

The present disclosure relates to a lamp provided with a projection lens.

BACKGROUND

A lamp configuration known in the related art is provided with a projection lens held by a lens holder, a light source disposed behind the projection lens, and a lamp body configured to hold the lens holder while accommodating the light source.

Japanese Patent Laid-Open Publication No. 2007-335301 discloses a lamp having a configuration in which a convex meniscus lens which has different vertical and horizontal curvatures is provided as a projection lens.

The projection lens of the lamp disclosed in Japanese Patent Laid-Open Publication No. 2007-335301 is configured such that the projection lens is fixed to the lens holder on the rear surface of outer peripheral edge and the outer peripheral surface thereof.

SUMMARY

In order to secure the entire diffusion angle sufficiently while increasing the central luminous intensity of a light distribution pattern formed by light irradiated from a lamp which includes a projection lens, the projection lens may be configured such that a central region of front surface thereof is configured by a convex curved surface and a peripheral region is configured by an annular concave curved surface.

Also, in order to improve the appearance of a lamp including a projection lens, an annular flange portion extending towards the inner peripheral side may be formed at the front end of a lens holder and the projection lens may be abutted against and fixed to the annular flange portion from the rear side.

When such a configuration is employed, however, the annular flange portion of the lens holder is disposed to protrude forward from the outer peripheral edge of the peripheral region on the front surface of the projection lens. Thus, there is a problem in that a portion of light emitted with a wide diffusion angle from the peripheral region of the front surface of the projection lens is shielded by the annular flange portion of the lens holder and as a result, light use efficiency for the emitted light from the light source deteriorates.

The present disclosure has been made in consideration of such a situation and an object thereof is to provide a lamp which includes a projection lens and is capable of increasing light use efficiency for emitted light from a light source while increasing the central luminous intensity of a light distribution pattern, securing a sufficient diffusion angle, and improving the appearance of the lamp.

The present disclosure achieves the above-described object by conducting a research on a configuration of the projection lens.

The lamp according to the present disclosure includes: a projection lens; a light source disposed at the rear side of the projection lens; a lens holder configured to hold the projection lens; and a lamp body configured to hold the lens holder while accommodating the light source. A front surface of the projection lens includes a central region which is configured by a convex curved surface and a peripheral region around the central region which is configured by a concave curved surface. The lens holder is formed in a cylindrical shape and an annular flange portion extending toward the inner peripheral side is formed at the front end of the lens holder. An annular step portion is formed at the outer peripheral edge of the peripheral region on the front surface of the projection lens, and the projection lens is fixed to the annular flange portion of the lens holder at a step surface of the annular step portion.

The usage of the "lamp" according to the present disclosure is not limited in particular in the present disclosure.

The kind of the "light source" is not limited in particular in the present disclosure and, for example, a light emitting diode may be employed as well.

A detailed position of a border line of the "central region" and the "peripheral region" on the front surface of the projection lens is not limited in particular in the present disclosure.

Although the "projection lens" is fixed to the annular flange portion of the lens holder on the step surface of the annular step portion, a detailed fixation configuration is not limited in particular in the present disclosure and, for example, welding, adhesion, and screw fastening may be employed as well.

As described in the above configuration, in the lamp according to the present disclosure, the central region on the front surface of the projection lens is configured by a convex curved surface and the peripheral region is configured by an annular concave curved surface. Therefore, the sufficient diffusion angle may be secured while increasing the central luminous intensity of the light distribution pattern formed by the radiated light from the lamp may.

Also, in the lamp according to the present disclosure, the lens holder configured to hold the projection lens is formed in a cylindrical shape and an annular flange portion extending towards the inner peripheral side at the front end of the lens holder is formed. Meanwhile, an annular step portion is formed at the outer peripheral edge of the peripheral region on the front surface of the projection lens and the projection lens is fixed to the annular portion of the lens holder at a step surface of the annular step portion. As a result, operational effects may be obtained as follows.

That is, since the projection lens is fixed in a state in which the outer peripheral edge of the peripheral region on the front surface of the projection lens is abutted against the annular flange portion of the lens holder from the rear side, the fixation portion may not be seen from the front of the lamp. Accordingly, the appearance of the lamp may be improved.

At this time, since the projection lens is fixed to the annular flange portion of the lens holder at the step surface of the annular step portion formed at the outer peripheral edge of the peripheral region on the front surface of the projection lens, it may be efficiently suppressed that a portion of light emitted with a wide diffusion angle from the peripheral region on the front surface of the projection lens is shielded by the annular flange portion of the lens holder. Therefore, the light use efficiency for the light emitted from the light source may be increased.

As described above, according to the present disclosure, in the lamp including the projection lens, the light use efficiency for the light emitted from the light source may be increased while increasing the central luminous intensity of the light distribution pattern, securing a sufficient diffusion angle, and improving the appearance of the lamp.

In the above-described configuration, when fixation of the projection lens to the lens holder is performed by welding, strong fixation may be achieved and sealability may be sufficiently secured. Also, when such a fixation configuration is employed, a need of a new member for fixation may be removed.

In the above-described configuration, when the lamp body has a cylindrical portion and the support of the lens holder by the lamp body is performed by screw-coupling the lens holder and the cylindrical portion of the lamp body, the secure support may be securely assured.

When the lens holder is configured to be relatively moved along a predetermined length range in the front-and-rear direction in relation to the cylindrical portion of the lamp body, a focal position of the projection lens may be adjusted in the front-and-rear direction. Accordingly, the form of the light distribution pattern formed by the radiated light from the lamp may be properly changed as desired.

In the above-described configuration, when the light source is constituted by a light emitting element, the lamp body may be formed of a metal material to utilize the lamp body as a heat sink to efficiently radiate heat generated from the light source.

The above-described summary is illustration purposes only and does not intend to limit in any ways. In addition to the illustrative embodiments, examples, and features described above, additional embodiments, examples, and features will become apparent by referring to the drawings and the following detailed descriptions.

BRIEF DESCRIPTION OF THE DRAWINGS

FIG. 6A is a view illustrating a state in which a lens holder is moved to the rear side to the maximum extent and FIG. 6B is a view illustrating a state in which the lens holder is moved to the front side to the maximum extent.

DETAILED DESCRIPTION

In the following detailed description, reference is made to the accompanying drawings which form a part hereof. The illustrative embodiments described in the detailed descriptions, drawings, and claims do not intend to limit. Other embodiments may be utilized and other modified examples may be made without departing from the spirit or scope of the subject matter presented here.

Hereinafter, an exemplary embodiment of the present disclosure will be described with reference to drawings.

Figure 1B:
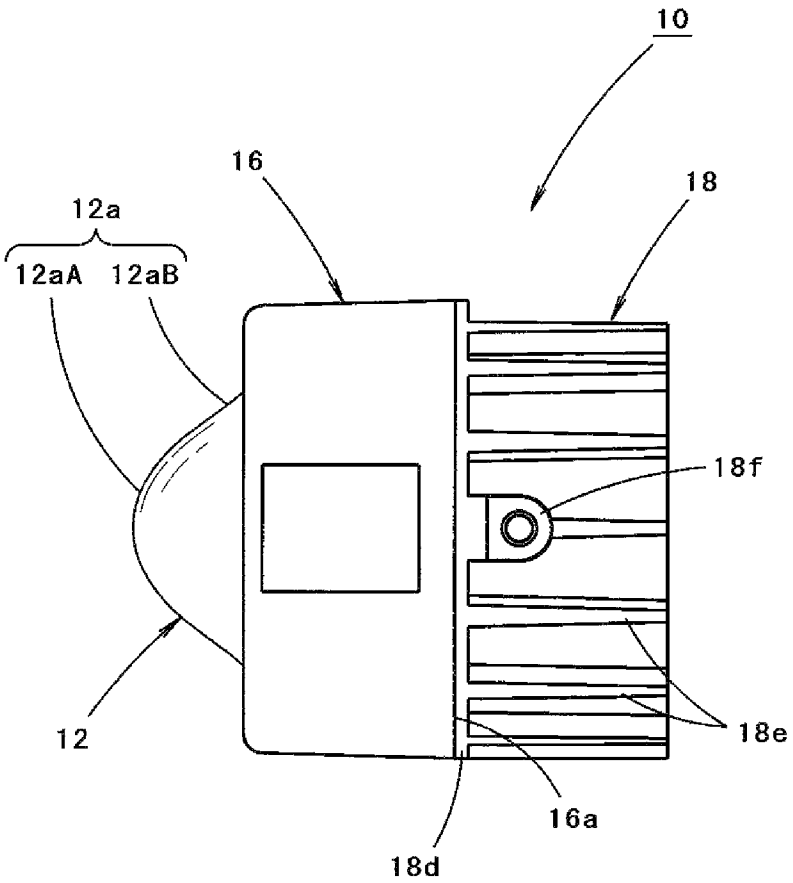
FIG. 1A is a front view illustrating a lamp according to an exemplary embodiment of the present disclosure and FIG. 1B is a side view illustrating the lamp.
Figure 1A:
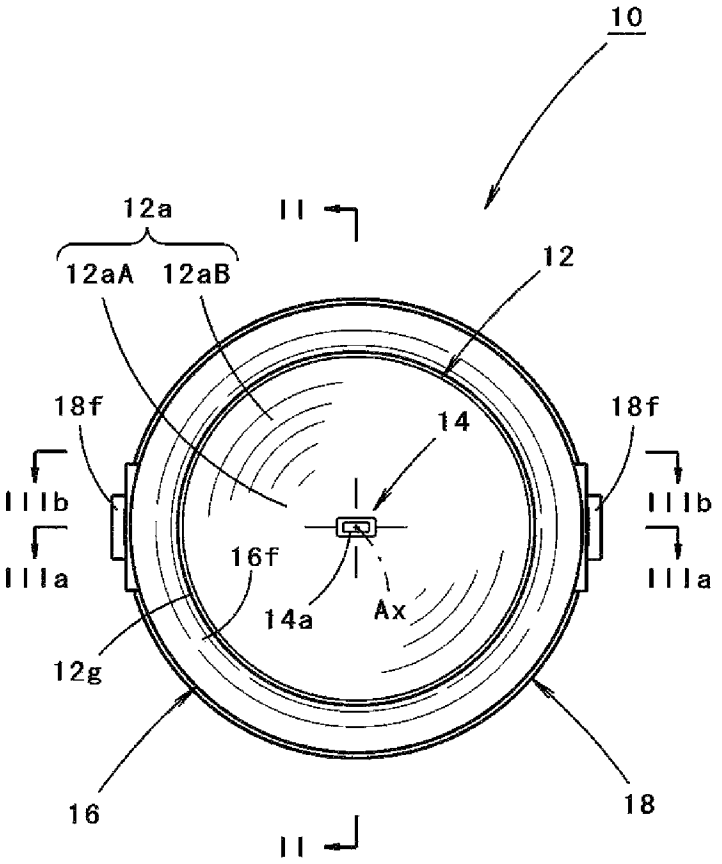
Figure 2:
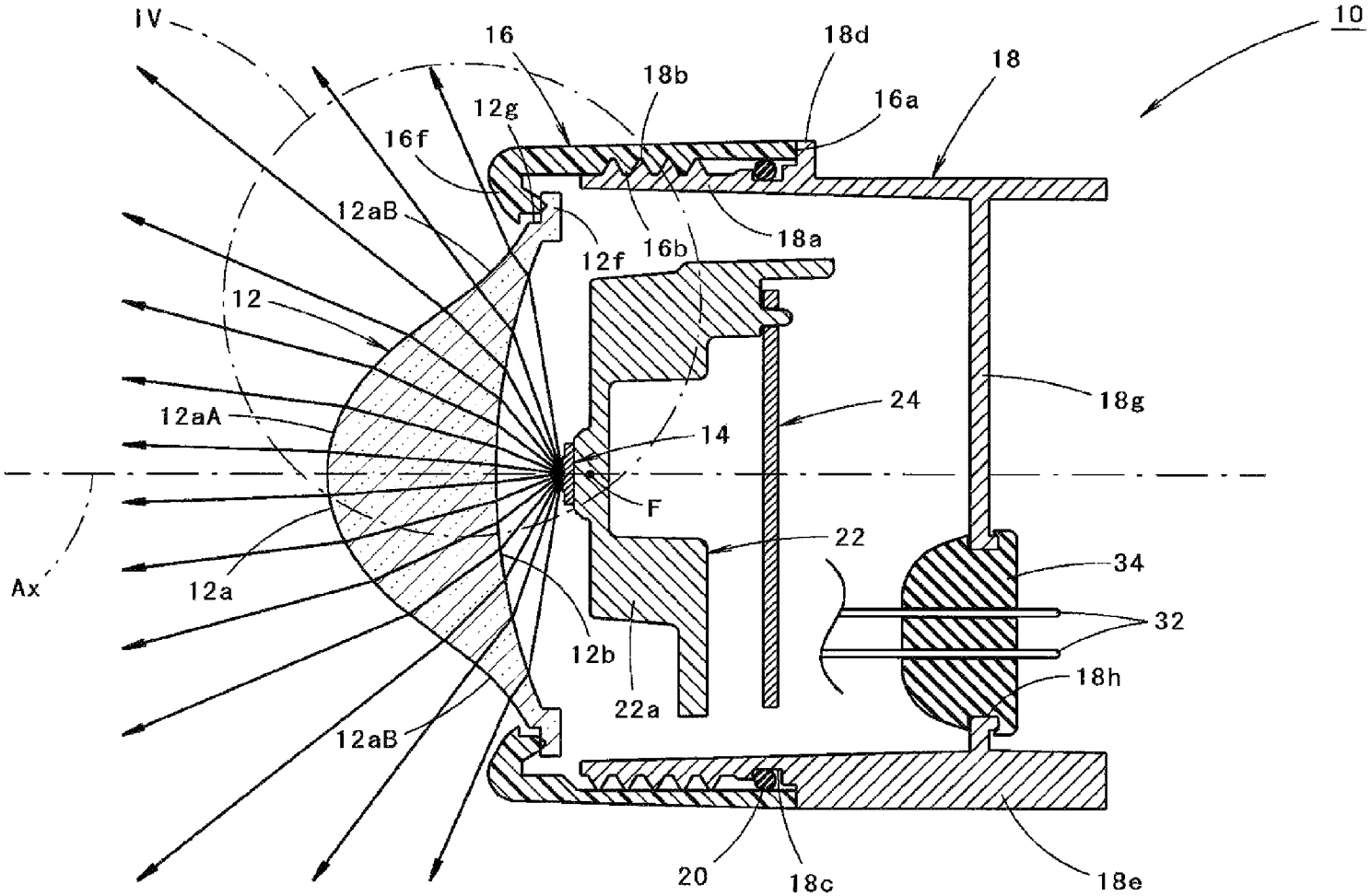
FIG. 2 is a cross-sectional view taken along line II-II of FIG. 1A.
Figure 3B:
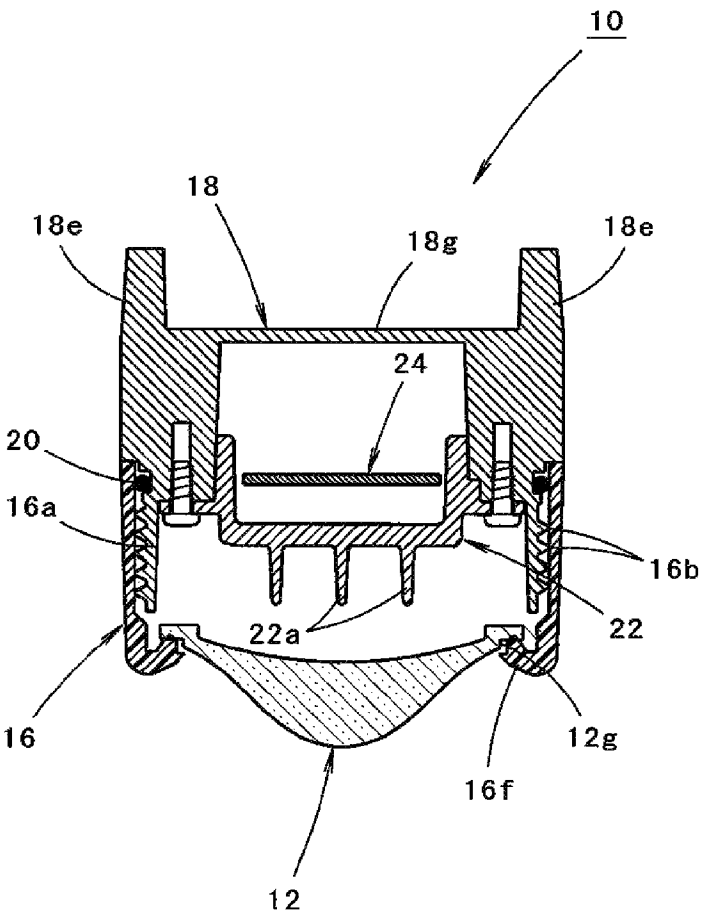
FIG. 3B is a cross-sectional view taken along line IIIb-IIIb of FIG. 1A.
Figure 3A:
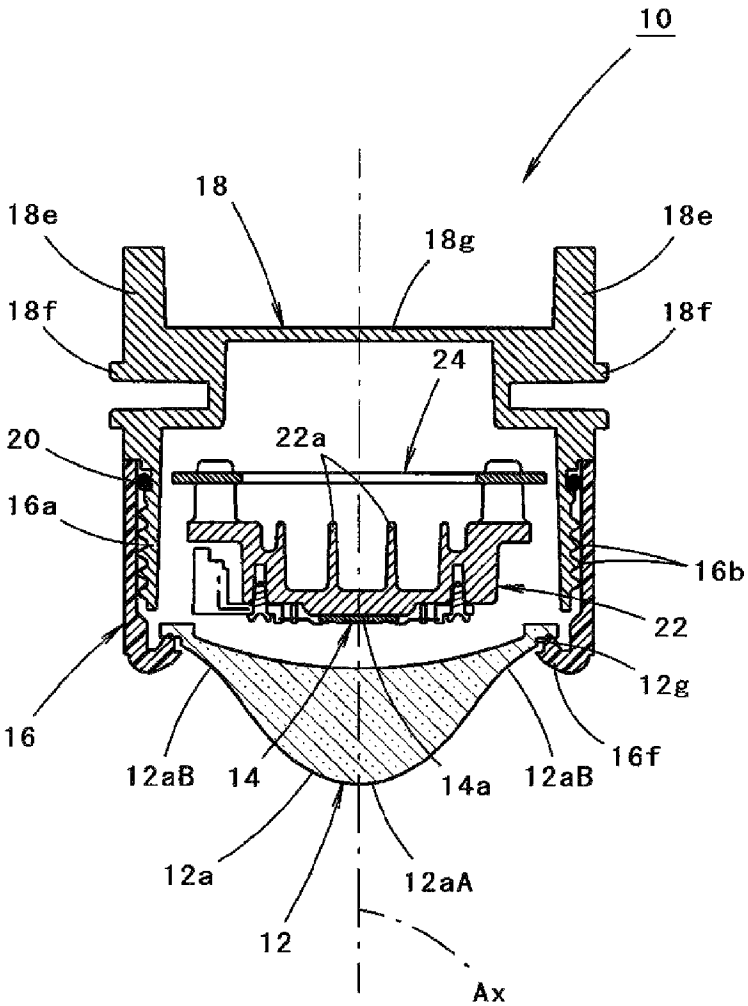
FIG. 3A is a cross-sectional view taken along line IIIa-IIIa of FIG. 1A

FIGS. 1A and 1B are views illustrating a lamp 10 according to an exemplary embodiment of the present disclosure. FIG. 1A is a front view and FIG. 1B is a side view. Also, FIG. 2 is a cross-sectional view taken along line II-II of FIG. 1A. Further, FIG. 3A is a cross-sectional view taken along line IIIa-IIIa of FIG. 1A and FIG. 3B is a cross-sectional view taken along line IIIb-IIIb of FIG. 1A.

As illustrated in the drawings, the lamp 10 according to the present exemplary embodiment is a kind of lamp used to irradiate the front side in a state in which the lamp 10 is attached to a working vehicle such as, for example, a folk lift.

The lamp 10 includes: a projection lens 12, a light source 14 disposed at the rear side of the projection lens 12, a lens holder 16 configured to hold the projection lens 12, and a lamp body 18 configured to hold the lens holder 16 while accommodating the light source 14.

Figure 4:
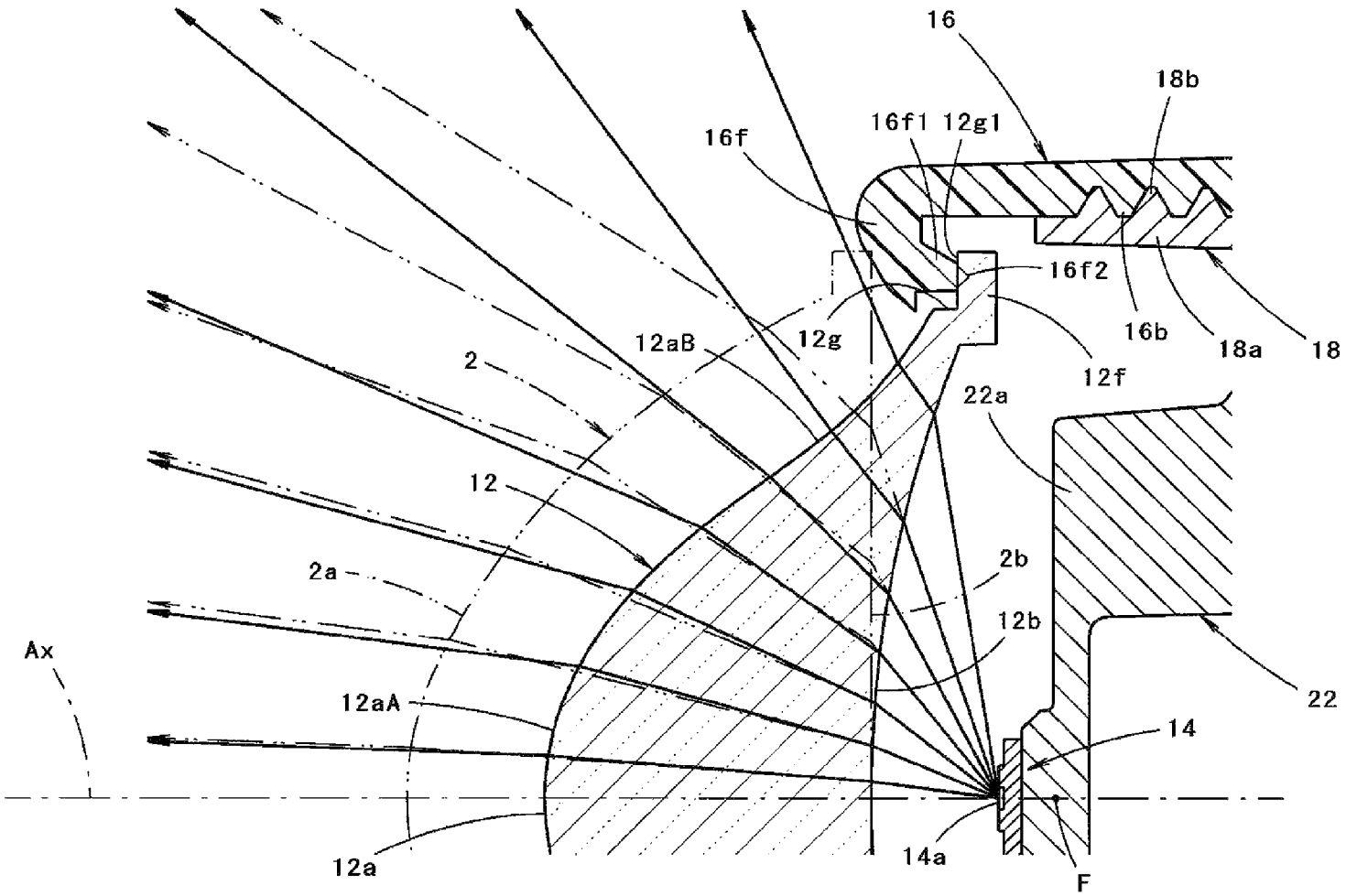
FIG. 4 is a detailed view of section IV of FIG. 2.

FIG. 4 is a detailed view of section IV of FIG. 2.

As illustrated in FIG. 4, the projection lens 12 is a colorless and transparent resin molded product. The projection lens 12 is configured as a rotational symmetric body in a convex meniscus lens form centered on an optical axis Ax extending in the front-and-rear direction of the lamp.

The front surface 12*a* of the projection lens 12 has a central region 12*af* which is configured as a convex curved surface centered on the optical axis Ax, and an annular peripheral region 12*a*B which is positioned around the central region 12*a*A and configured as a concave curved surface centered on the optical axis Ax. In this case, the central region 12*a*A and the peripheral region 12*a*B are formed to be smoothly connected.

Meanwhile, a rear surface 12*b* of the projection lens 12 is configured as a spherical surface centered on the optical axis Ax.

Also, a flange portion 12*f* is formed at the outer peripheral edge of the projection lens 12. The flange portion 12*f* is formed in a flat annular shape centered on the optical axis Ax and the rear surface of the flange portion 12*f* is positioned at the further rear side of the outer peripheral edge of the rear surface 12*b* of the projection lens 12.

Meanwhile, on the front surface 12*a* of the projection lens 12, an annular step portion 12*g* which is stepped down to the rear side is formed at the outer peripheral edge of the peripheral region 12*a*B. A step surface 12*g*1 of the annular step portion 12*g* is formed as an annular surface which is perpendicular to the optical axis Ax. The step surface 12*g*1 forms the front surface of the flange portion 12*f*.

The lens holder 16 is a colored (for example, black) resin molded product formed in a cylindrical member which extends to the front and rear direction and is centered on the optical axis Ax.

An annular flange portion 16*f* extending towards the inner peripheral side of the lens holder 16 is formed at the front end of the lens holder 16. The front surface of this annular flange portion 16*f* is an annular curved surface which is convex towards the front and the rear surface is an annular surface which is perpendicular to the optical axis Ax. Also, an annular protrusion 16*f*1 which has a trapezoidal cross-section and protrudes towards the rear is formed on the rear surface of the annular flange portion 16*f*.

The projection lens 12 is fixed to the annular protrusion 16*f*1 of the annular flange portion 16*f* of the lens holder 16 on the step surface 12*g*1 of the annular step portion 12*g*. This fixation is performed by welding such as, for example, ultrasonic welding in a state in which the step surface 12*g*1 of the projection lens 12 is compressed against the annular protrusion 16*f*1 of the lens holder 16 from the rear side. In order to implement this, an annular protrusion 16*f*2 which has a triangular cross-section and protrudes towards the rear is formed as a welding margin at the rear surface of the annular protrusion 16*f*1 of the lens holder 16.

The lamp body 18 is a member formed of a metal material (for example, an aluminum die-cast product) and is provided with a cylindrical portion 18*a* which is centered on the optical axis Ax and extends in the front-and-rear direction.

The lens holder 16 is supported by the lamp body 18 by screw-coupling the lens holder 16 and the cylindrical portion 18*a* of the lamp body 18. In order to implement this, an external screw portion 18*b* is formed at the front end of the outer peripheral surface of the cylindrical portion 18*a* of the lamp body 18 and an internal screw portion 16*b* is formed on the inner peripheral surface of the lens holder 16. In this case, the external screw portion 18*b* is formed around the whole periphery of the cylindrical portion 18*a*. However, the internal screw portion 16*b* is partially formed at three positions in the peripheral direction of the lens holder 16 with the same angular intervals.

An annular groove 18*c* is formed at the rear side of the external screw portion 18*b* on the outer peripheral surface of the cylindrical portion 18*a* of the lamp body 18, and the annular groove 18*c* is mounted with an O ring 20. The O ring 20 is adapted to secure the sealability between the lens holder 16 and the lamp body 18.

Also, an annular flange portion 18*d* is formed at the rear side of the annular groove 18*c* on the outer peripheral surface of the cylindrical portion 18*a* of the lamp body 18. When the rear end surface 16*a* of the lens holder 16 is contacted with the annular flange portion 18*d*, the positioning of the lens holder 16 in the front-and-rear direction may be achieved.

Further, on the rear side of the annular flange portion 18*d* in the outer peripheral surface of the cylindrical portion 18*a* of the lamp body 18, a plurality of cooling fins 18*e* extending in the front-and-rear direction are formed with predetermined intervals in the peripheral direction.

Furthermore, boss portions 18*f* having a screw hole for attaching the lamp 10 to the working vehicle are formed at both left and right sides of the lamp body 18, respectively.

The light source 14 is constituted by a light emitting element. The light emitting element is a white light emitting diode and has a light emitting surface 14*a* in a horizontally long rectangular shape.

The light emitting surface 14*a* of the light source 14 is disposed facing the front on the optical axis Ax. The light source 14 is held by a light source holding member 22.

The light source holding member 22 is a member formed of a metal material (for example, an aluminum die-cast product) and formed with a plurality of cooling fins 22*a*. Also, a print board 24 electrically connected with the light source 14 is fixed to the light source holding member 22 by screw-fastening. Also, the light source holding member 22 is fixed to the lamp body 18 by screw-fastening.

Meanwhile, the lamp body 18 is formed with a cord insertion hole 18*h* through the rear wall 18*g* thereof and a cord 32 which extends from the print board 24 is inserted through the cord insertion hole 18*h*. The cord insertion hole 18*h* is equipped with a packing 34 which supports the cord 32 inserted therethrough. With this configuration, the water-tightness of the space within the lamp body 18 is secured.

As illustrated in FIGS. 2 and 4, a rear side focus F of the projection lens (precisely, a rear side focus of the central portion of the lens configured by the central region 12*a*A of the front surface 12*a* and on the rear surface 12*b*) is disposed on the optical axis Ax slightly behind the light emitting surface 14*a* of the light source 14.

Light emitted from the light emitting center of the light source 14 (i.e., the central position of the light emitting surface 14*a*) and incident on the rear surface 12*b* of the projection lens 12 is emitted to the front from the front surface 12*a* of the projection lens 12. In this case, the light emitted from the central region 12*a*A of the front surface 12*a* is refracted to the inner peripheral side and oriented to the direction of the optical axis Ax side and the light emitted from the peripheral region of the front surface 12*a* is refracted towards the outer peripheral side and oriented away from the optical axis Ax.

The light emitted from the vicinity of the outer peripheral edge of the peripheral region 12*a*B of the front surface 12*a* is emitted with a wide diffusion angle for the optical axis Ax. However, since the projection lens 12 is fixed to the annular flange portion 16*f* of the lens holder 16 on the step surface 12*g*1 of the annular step portion 12*g* and hence a front protruding amount of the annular flange portion 16*f* is suppressed, the light emitted from the peripheral region 12*a*B and shielded by the annular flange portion 16*f* is suppressed to a minimum.

Figure 5B:
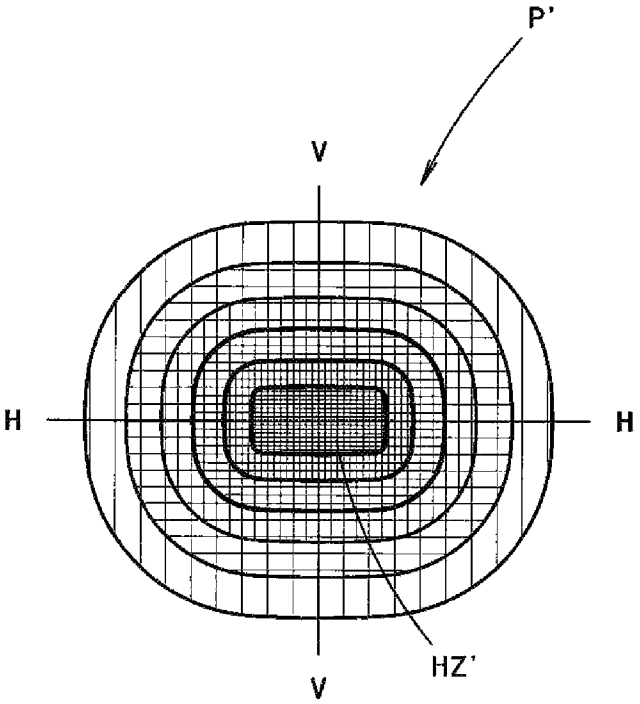
FIG. 5B is a view corresponding to FIG. 5A and illustrating the light distribution pattern as a comparison example, which is the same view as FIG. 5A.
Figure 5A:
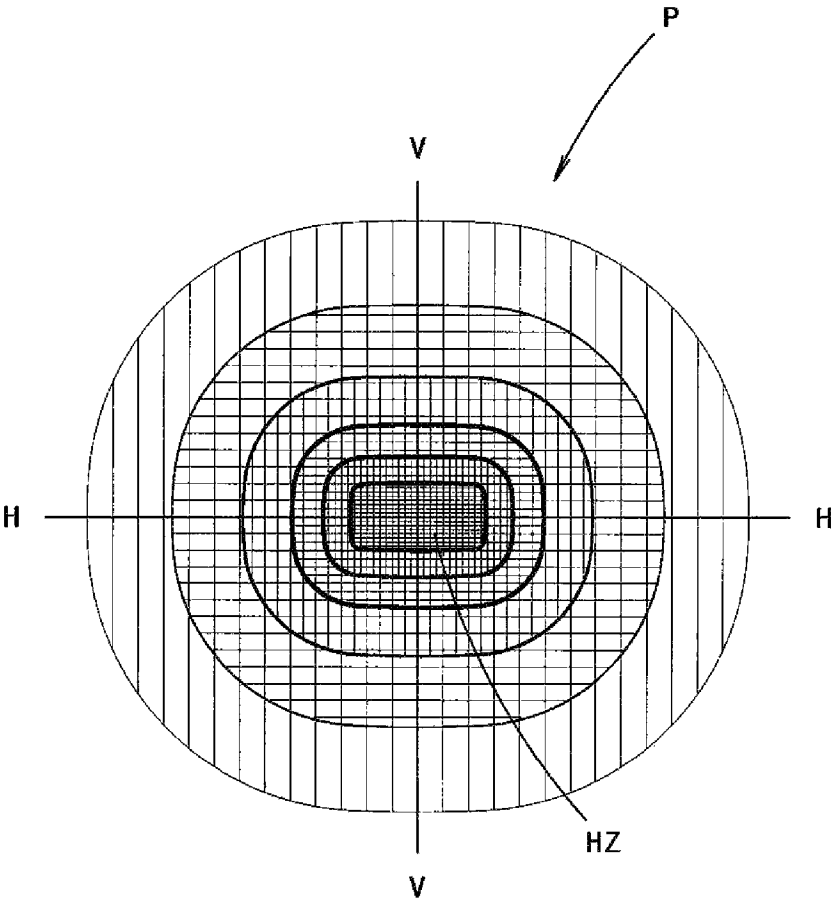
FIG. 5A is a view illustrating a light distribution pattern formed on a virtual vertical screen disposed at the front of the lamp by light irradiated forward from the lamp.

FIG. 5A is a view illustrating a light distribution pattern P formed on a virtual vertical screen disposed in front of the lamp by light irradiated forward from the lamp 10 according to the present exemplary embodiment.

The light distribution pattern P is formed by the light which is emitted from the light source 14 and penetrates the projection lens. However, since the light source 14 has the light emitting surface 14*a* in a horizontally long rectangular shape, a hot zone ("HZ") which is a high luminous intensity region of the light distribution pattern P is formed to be slightly longer in the horizontal length as well.

In this case, since the light emitted from the central region 12*a*A of the front surface 12*a* of the projection lens 12 is oriented to the direction of the optical axis Ax side, the hot zone HZ and the peripheral portion thereof have sufficient brightness. Meanwhile, since the light from emitted the peripheral region 12*a*B of the front surface 12*a* of the projection lens 12 is oriented away from the optical axis Ax, the light distribution pattern P becomes a light distribution pattern having a large extension in which the brightness gradually decreases towards the outer peripheral edge of the light distribution pattern P.

FIG. 5B is a view illustrating a light distribution pattern P' as a comparison example of the present exemplary embodiment.

The light distribution pattern P' is a light distribution pattern which is formed when a conventional projection lens 2 as depicted with two-dot dash lines is disposed in FIG. 4 instead of the projection lens 12.

The projection lens 2 is a plane-convex lens of which the front surface 2*a* is a convex curved surface and the rear surface 2*b* is a flat surface. As illustrated with two-dot dash lines in FIG. 4, the light emitted from the light emitting center of the light source 14 and incident on the rear surface 2*b* of the projection lens 2 is refracted towards the inner peripheral side in the whole region of the front surface 2*a* of the projection lens 2 and oriented to the direction of the optical axis Ax side.

Thus, as illustrated in FIG. 5B, the light distribution pattern P' is the same as the light distribution pattern P in that the hot zone HZ' and the peripheral portion thereof have sufficient brightness. However, the overall extension is smaller than that of the light distribution pattern P and the brightness is drastically decreased at the outer peripheral edge.

Next, acting effects of the present exemplary embodiment will be described.

In the lamp 10 according to the present exemplary embodiment, since the central region 12*a*A of the front surface 12*a* of the projection lens 12 has a convex curved surface and the peripheral region 12*a*B has a concave curved surface, a sufficient diffusion angle may be secured while increasing the central luminous intensity of the light distribution pattern P formed by the emitted light from the lamp 10.

Also, in the lamp 10 according to the present exemplary embodiment, the lens holder configured to hold the projection lens 12 is formed in a cylindrical shape and the annular flange portion 16*f* extending towards the inner peripheral side is formed at the front end of the projection lens 12. In addition, the annular step portion 12*g* is formed at the outer peripheral edge of the peripheral region 12*a*B on the front surface 12*a* of the projection lens 12 and the projection lens 12 is fixed at the annular flange portion 16*f* of the lens holder 16 on the step surface 12*g*1 of the annular step portion 12*g*. Thus, acting effects as follows may be obtained.

That is, since the projection lens 12 is fixed in a state in which the outer peripheral edge of the peripheral region 12*a*B on the front surface 12*a* thereof is abutted against the annular flange portion 16*f* of the lens holder 16 from the rear side, the fixation portion may not be seen from the front of the lamp. Accordingly, the appearance of the lamp 10 may be improved.

Since the projection lens 12 is fixed at the annular flange portion 16*f* of the lens holder 16 on the step surface 12*g*1 of the annular step portion 12*g* formed at the outer peripheral edge of the peripheral region 12*a*B on the front surface of the projection lens, it may be efficiently suppressed that a part of the light emitted with a wide diffusion angle from the peripheral region 12*a*B on the front surface 12*a* of the projection lens 12 is shielded by the annular flange portion 16*f* of the lens holder 16. Accordingly, the light use efficiency of the emitted light from the light source 14 may be increased.

As described above, according to the present exemplary embodiment, in the lamp including the projection lens 12, the light use efficiency for the emitted light from the light source 14 may be increased while increasing the central luminous intensity of the light distribution pattern P, a sufficient diffusion angle may be secured, and the appearance of the lamp 10 may be further improved.

In the present exemplary embodiment, since the fixation of the projection lens 12 for the lens holder 16 is performed by welding, the fixation may be strongly performed and the sealability may be sufficiently secured. Therefore, the watertightness of the inner space of the lamp body 18 may be facilitated while securing air permeability of the inner space and outer space of the lamp body 18. Also, when such a fixation configuration is employed, the necessity of a new member (e.g., a screw or an adhesive) for the fixation may be removed.

Also, in the present exemplary embodiment, since the lamp body 18 has the cylindrical portion 18*a* and the lens holder 16 is supported by the lamp body 18 by screw-coupling the lens holder 16 and the lamp body 18, the support may be securely performed.

Further, in the present exemplary embodiment, although the light source 14 is constituted by the light emitting element, the lamp body 18 may be utilized as a heat sink to radiate the heat generated from the light source 14 since the lamp body 18 is configured by a member formed of a metal material. In this case, since the light source holding member 22 that holds the light source is configured by a member of a metal material and the lamp body 18 is fixed to the light source holding member 22, the light source holding member 22 may also be used as the heat sink together with the lamp body 18.

In the above-described exemplary embodiment, it has been described that the lamp 10 is attached to a working vehicle such as, for example, a fork lift. However, it may be used for other uses (e.g., lighting at shops or street lights).

Next, a modified example of the above-described exemplary embodiment will be described.

Figure 6B:
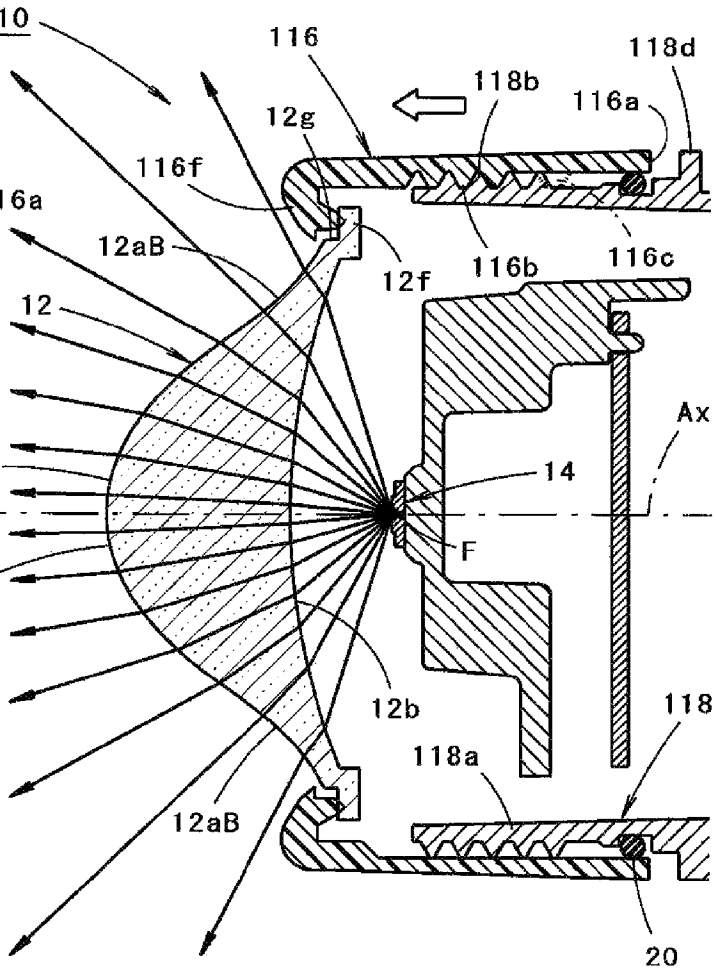
FIGS. 6A and 6B are views substantially corresponding to FIG. 2 and illustrating principal parts of a lamp according to a modified example of the exemplary embodiment.
Figure 6A:
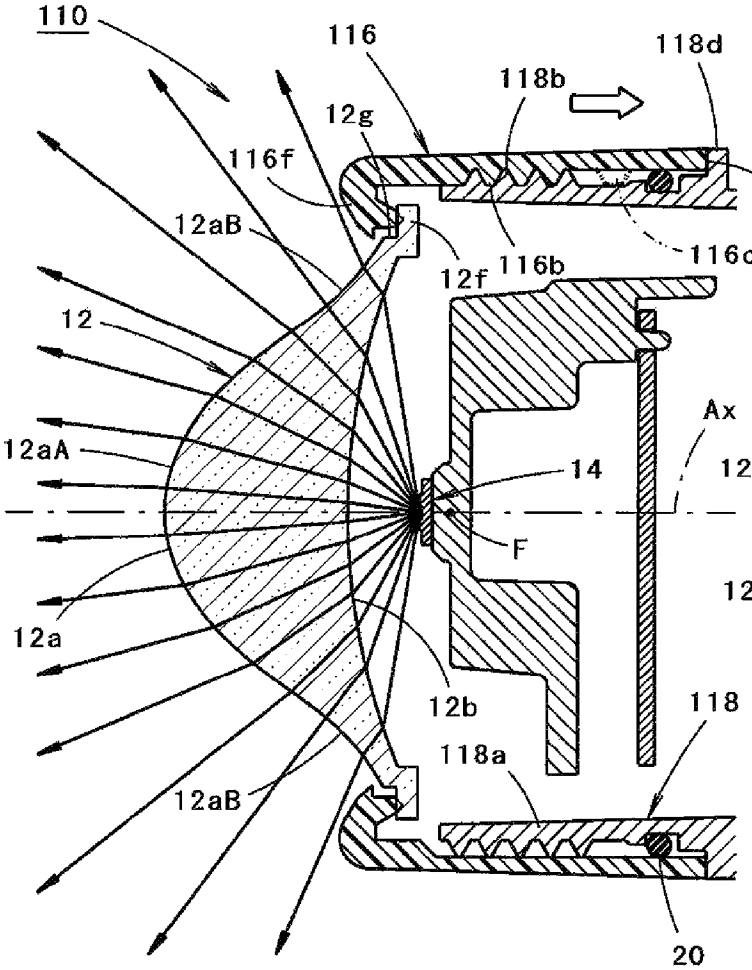

FIGS. 6A and 6B are views illustrating principal parts of the lamp 110 according to the modified example of the exemplary embodiment and substantially corresponding to FIG. 2. Also, FIG. 7 is a perspective view illustrating a lens holder 116 of the lamp 110 when it is viewed as a single item obliquely from the rear side.

As illustrated in FIGS. 6A and 6B, in the present modified example, the lens holder 116 is configured to be relatively movable over a predetermined length range in the front-and-rear direction in relation to the cylindrical portion 118*a* of the lamp body 118. FIG. 6A is a view illustrating a state in which the lens holder 116 is moved rearward to the maximum extent and FIG. 6B is a view illustrating a state in which the lens holder 116 is moved forward to the maximum extent.

Figure 7:
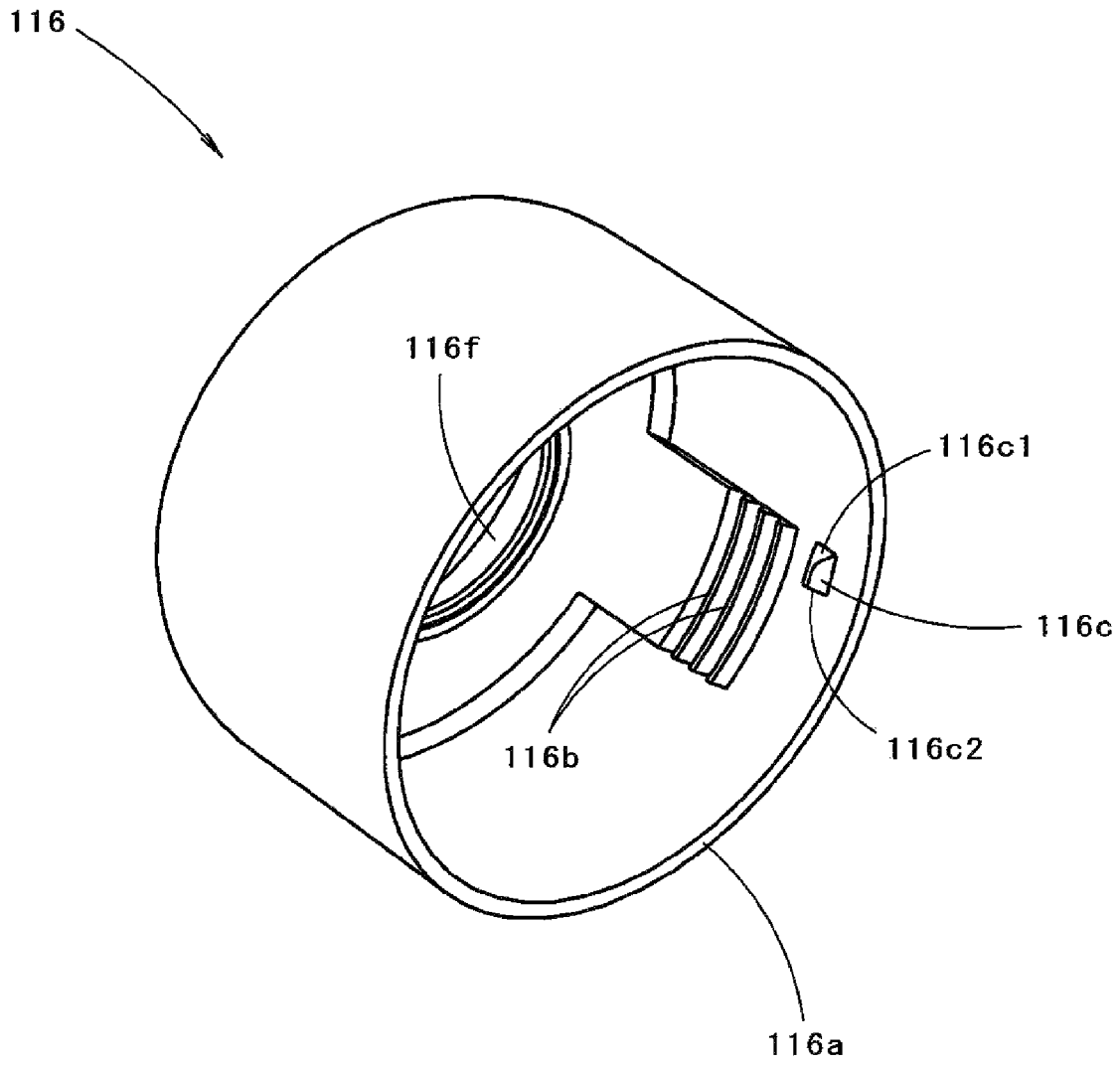
FIG. 7 is a perspective view illustrating a lens holder of the modified example when it is seen as a single item diagonally from the rear.

As illustrated in FIG. 7, the lens holder 116 of the present modified example is formed with a protrusion 116*c* at a location spaced apart rearward from the internal screw portion 116*b* on the inner peripheral surface of the lens holder 116.

The protrusion 116*c* is formed on an extending line of a spiral curve which serves as a basis for the internal screw portion 116*b* extending spirally. At this time, the protrusion 116*c* has a trapezoidal cross-sectional shape of which the front-and-rear width is slightly larger than that of the internal screw portion 116*b*. Also, in the cross-sectional shape in the direction according to the spiral curve of the protrusion 116*c*, a first surface 116*c*1 where the front side is disposed when the lens holder 116 is assembled to the cylindrical portion 118*a* of the lamp body 118 is formed in a slow-sloped surface and a second surface 116*c*2 where the rear side is disposed is formed in a steep-sloped surface.

When the lens holder 116 is assembled to the cylindrical portion 118*a* of the lamp body 118, the protrusion 116*c* is caused to ride on and move along a spiral groove of the external screw portion 118*b* the front end side along and to be released from the engagement with the spiral groove beyond the formation range of the external screw portion 118*b*. Even after the engagement with the spiral groove is released, the lens holder 116 may be moved rearwards up to the position where a rear end surface 116*a* is contacted to an annular flange portion 118*d* of the lamp body 118*d*. Meanwhile, after the engagement with the spiral groove is released, the forward movement of the lens holder 116 is restricted within the range to the position where the second surface 116*c*2 of the protrusion 116*c* is abutted to the front end position of the external screw portion 118*b*.

In the present modified example, in order to ensure the sealability by the O-ring 20 between the lens holder 116 and the lamp body 118 over the whole movement range region of the lens holder 116, the rear end surface 116*a* of the lens holder 116 is displaced further rearward than the rear side surface 16*a* of the lens holder 16 of the above-described exemplary embodiment and the annular flange portion 118*d* of the lamp body 118 is also displaced further rearward by an amount corresponding to the displacement of the rear end surface 116*a* of the lens holder 116.

As illustrated in FIG. 6A, when the lens holder 116 is moved to the maximum extent, the light path of the emitted light from the projection lens 12 is the same as that of the above-described exemplary embodiment. However, as illustrated in FIG. 6B, when the lens holder 116 is moved forward to the maximum extent, the rear side focus F of the projection lens 12 approaches closely to the emitting center of the light source 14. Thus, the light from emitted the projection lens 12 is oriented further towards the optical axis Ax side direction generally than that shown in FIG. 6A and as a result, the light condensing property may be enhanced.

However, in the light distribution pattern formed in this case, the brightness gradually decreases towards the outer peripheral edge as in the light distribution pattern P illustrated in FIG. 5A.

When the lens holder 116 is configured to be relatively movable along the predetermined length range in the front-and-rear direction in relation to the cylindrical portion 118*a* of the lamp body 118 like the lamp 110 according to the present modified example, it becomes possible that the focal position of the projection lens 12 is adjusted in the front-and-rear direction and as a result, the shape of the light distribution pattern formed by the emitted light from the lamp 110 may be properly changed as desired.

Of course, numerical values provided as specifications in the exemplary embodiment and the modified example are merely examples and may be properly set to different values.

Also, the present disclosure is not limited to configurations recited in the exemplary embodiment and the modified example and may employ other configurations to which various changes may added.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A lamp comprising:

a projection lens;

a light source disposed behind the projection lens;

a lens holder configured to hold the projection lens; and a lamp body configured to be fixed to a vehicle and hold the lens holder while accommodating the light source, wherein a front surface of the projection lens includes a central region which is configured by a convex curved surface and a peripheral region around the central region which is configured by an annular concave curved surface, the lens holder is formed in a cylindrical shape and an annular flange portion extending towards an inner peripheral side is formed at a front end of the lens holder, an annular step portion which is stepped down to a rear side is formed at an outer peripheral edge of the peripheral region on the front surface of the projection lens, and the projection lens is fixed to the annular flange portion of the lens holder only from the rear side at a step surface of the annular step portion such that the projection lens can be held only by the lens holder when the lamp is used to irradiate the front side in a state in which the lamp is attached to the vehicle, wherein the projection lens is fixed to the lens holder by welding.

2. The lamp of claim 1, wherein the lamp body has a cylindrical portion, and the lens holder is supported by the lamp body by screw-coupling the lens holder and the cylindrical portion of the lamp body.

3. The lamp of claim 2, wherein the lens holder is relatively movable along a predetermined length range in the front-and-rear direction in relation to the cylindrical portion of the lamp body.

4. The lamp of claim 3, wherein the light source is constituted by a light emitting element, and the lamp body is a member formed of a metal material.

5. The lamp of claim 2, wherein the light source is constituted by a light emitting element, and the lamp body is a member formed of a metal material.

6. The lamp of claim 2, wherein, when the lens holder is moved forward to the maximum extent, the light condensing property of the light emitted from the projection lens is enhanced.

7. The lamp of claim 1, wherein the light source is constituted by a light emitting element, and the lamp body is a member formed of a metal material.

8. The lamp of claim 1, wherein an annular protrusion is formed on a rear surface of the annular flange portion of the lens holder.

9. The lamp of claim 8, wherein the annular protrusion includes a trapezoidal cross-section protruding towards the rear side of the lens holder.

* * * * *